US009108223B2

(12) United States Patent
Sato

(10) Patent No.: US 9,108,223 B2
(45) Date of Patent: Aug. 18, 2015

(54) SORTING APPARATUS AND CONTROL METHOD FOR SORTING APPARATUS

(75) Inventor: Masanori Sato, Yamato (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 590 days.

(21) Appl. No.: 12/054,870

(22) Filed: Mar. 25, 2008

(65) Prior Publication Data

US 2009/0166270 A1 Jul. 2, 2009

(30) Foreign Application Priority Data

Dec. 27, 2007 (JP) ..... 2007-337799

(51) Int. Cl.
*B07C 5/34* (2006.01)
*B07C 1/00* (2006.01)
*B07C 1/16* (2006.01)

(52) U.S. Cl.
CPC .... *B07C 1/00* (2013.01); *B07C 1/16* (2013.01)

(58) Field of Classification Search
USPC ..... 209/584, 900, 659, 586, 645
IPC ..... B07C 1/00,1/16
See application file for complete search history.

(56) References Cited

U.S. PATENT DOCUMENTS 3,106,285 A * 10/1963 Gleeson ..... 198/824
4,863,037 A * 9/1989 Stevens et al. ..... 53/381.3
5,036,310 A * 7/1991 Russell ..... 340/569
5,054,620 A * 10/1991 DeWitt et al. ..... 209/3.1
5,054,700 A * 10/1991 DeWitt ..... 241/101.4
5,115,918 A * 5/1992 DeWitt et al. ..... 209/3.1
5,240,116 A * 8/1993 Stevens et al. ..... 209/534
5,420,403 A * 5/1995 Allum et al. ..... 235/375
5,460,273 A * 10/1995 Stevens et al. ..... 209/584
5,464,099 A * 11/1995 Stevens et al. ..... 209/3.1
5,600,303 A * 2/1997 Husseiny et al. ..... 340/568.1
5,637,811 A * 6/1997 Simard et al. ..... 73/865.8
6,003,677 A * 12/1999 Foley ..... 209/2
6,112,902 A * 9/2000 Hayduchok et al. ..... 209/3.3
6,114,646 A * 9/2000 Montgomery ..... 209/562
6,311,846 B1 * 11/2001 Hayduchok et al. ..... 209/3.3

(Continued)

FOREIGN PATENT DOCUMENTS

DE 103 50 623 B3 4/2005
GB 2 265 464 A 9/1993

(Continued)

OTHER PUBLICATIONS

European Search Report dated May 8, 2009 for 08005579.1-2307.

(Continued)

*Primary Examiner* — Stefanos Karmis
*Assistant Examiner* — Michael E Butler
(74) *Attorney, Agent, or Firm* — Oblon, Mclelland, Maier & Neustadt, L.L.P.

(57) ABSTRACT

A sorting apparatus conveys a sheet in a standing position, and detects, at various heights, the presence/absence of metal pieces in the sheet, conveyed in the standing position, by using a plurality of metal detection sensors. The sorting apparatus detects a tracking letter in which a metal piece is placed at a specific position or a clip letter containing a small metal piece whose position is fixed, on the basis of the detection result obtained by each metal detection sensor, and sorts the tracking letter or the clip letter in the same manner as a normal letter.

9 Claims, 7 Drawing Sheets

(56) References Cited

U.S. PATENT DOCUMENTS

| | | | | |
|---|---|---|---|---|
| 6,381,342 | B2 * | 4/2002 | Foley | 382/101 |
| 6,481,624 | B1 | 11/2002 | Hayduchok | |
| 7,067,089 | B2 * | 6/2006 | Wen | 422/292 |
| 2003/0132398 | A1 * | 7/2003 | Wang | 250/492.1 |
| 2007/0252321 | A1 * | 11/2007 | Kutzer et al. | 271/34 |
| 2009/0234497 | A1 * | 9/2009 | Uejo | 700/226 |
| 2011/0290568 | A1 * | 12/2011 | Asari et al. | 177/1 |
| 2012/0133932 | A1 * | 5/2012 | Henry et al. | 356/301 |

FOREIGN PATENT DOCUMENTS

| | | |
|---|---|---|
| JP | 07-333351 | 12/1995 |
| JP | 08-243500 | 9/1996 |
| JP | 10-149471 | 6/1998 |
| JP | 2000-334387 | 12/2000 |
| JP | 2001-137787 | 5/2001 |
| JP | 2001-232299 | 8/2001 |
| JP | 2003-285957 | 10/2003 |
| KR | 2006-0112655 | 11/2006 |

OTHER PUBLICATIONS

Korean Office Action dated Oct. 23, 2009.

Japanese Office Action dated Aug. 7, 2012.

* cited by examiner

SORTING APPARATUS AND CONTROL METHOD FOR SORTING APPARATUS

CROSS-REFERENCE TO RELATED APPLICATIONS

This application is based upon and claims the benefit of priority from prior Japanese Patent Application No. 2007-337799, filed Dec. 27, 2007, the entire contents of which are incorporated herein by reference.

BACKGROUND OF THE INVENTION

1. Field of the Invention

The present invention relates to a sorting apparatus which reads, for example, surfaces of sheets such as postal matter on which sorting information such as postal codes are written, and sorts the sheets by performing character recognition on read images, and a control method for the sorting apparatus.

2. Description of the Related Art

A conventional sorting apparatus which sorts sheets reads images on sheets, and sorts the sheets by recognizing characters as sorting information indicating sorting destinations from the read images. For a sheet on which sorting information such as a postal code comprising a seven-digit number or the like is written, this apparatus extracts a character area from a read image, and sorts the sheet by recognizing the character in the area.

A sorting apparatus like that described above sorts a plurality of sheets such as sealed letters or postcards while sequentially conveying them on a convey path. For this reason, a sheet like a sealed letter containing a foreign substance may cause a problem in the process of being conveyed in the sorting apparatus. Some conventional sorting apparatus has a mechanism of detecting a foreign substance contained in a sheet and rejecting the sheet (for example, Jpn. Pat. Appln. KOKAI Publication No. 2003-285957). An example of such a mechanism of detecting a foreign substance contained in a sheet is a mechanism provided with a metal detection unit for detecting a metal piece as a foreign substance contained in a sheet.

In the conventional sorting apparatus, however, a tracking letter (such as a transponder letter or vibration letter) having a metal member is rejected by being detected as a sheet containing a foreign substance by the above metal detection unit. In addition, in the conventional sorting apparatus, even a sheet attached with a small metal piece (e.g., a small fastening plate such as a clip) in a fixed state which is unlikely to cause any problem during conveyance is detected as a sheet containing a foreign substance by the above metal detection unit and rejected. In general, a worker needs to manually sort an rejected sheet. When, for example, the worker manually sorts a tracking letter, it is difficult to grasp the overall processing state of a system which sorts sheets by using the tracking letter. In addition, when the worker needs to manually sort sheets which are unlikely to cause any problem, the overall processing efficiency of the above sorting apparatus deteriorates.

BRIEF SUMMARY OF THE INVENTION

It is an object of the present invention to provide a sorting apparatus which can implement efficient sorting processing for sheets, and a control method for the sorting apparatus.

According to an aspect of the present invention, there is provided a sorting apparatus comprising a plurality of sensors which detect the presence/absence of a metal piece in a sheet in a standing position at various heights, a determination unit which determines on the basis of a pattern of detection of a metal piece in the sheet by the plurality of sensors whether the sheet is a sheet to be rejected, an rejection unit which rejects a sheet determined to be rejected by the determination unit, and a sorting unit which sorts, on the basis of sorting information of a sheet, the sheet determined, by the determination unit, not to be rejected.

A control method for a sorting apparatus according to an aspect of the present invention is a control method used for a sheet sorting apparatus comprises causing a plurality of sensors placed at various heights to detect the presence/absence of a metal piece in a sheet in a standing position, determining on the basis of a pattern of detection of a metal piece in the sheet by the plurality of sensors whether the sheet is a sheet to be rejected, rejecting a sheet determined to be rejected by the determination; and sorting, on the basis of sorting information of a sheet, the sheet determined not to be rejected by the determination.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiments of the present invention will be described below with reference to the views of the accompanying drawing.

Figure 1:
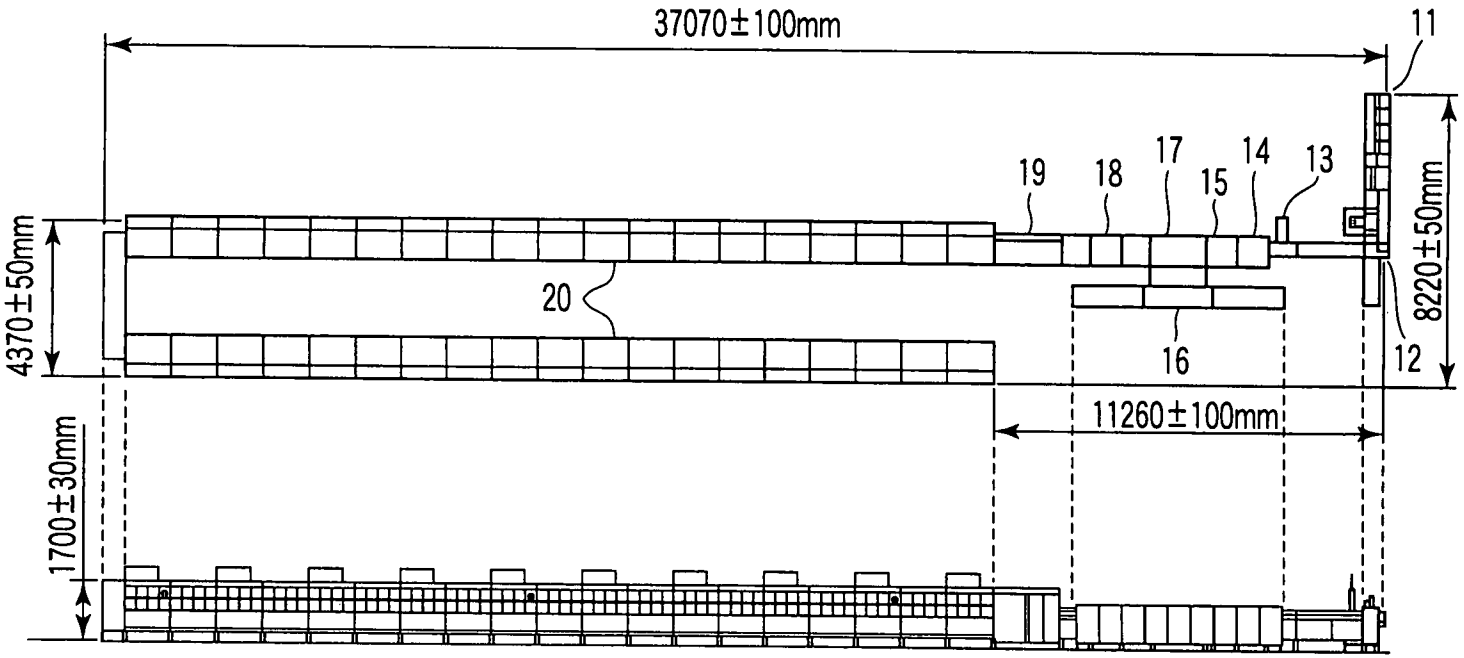
FIG. 1 is a view showing an example of the external arrangement of a sheet sorting apparatus according to an embodiment of the present invention.

FIG. 1 is a view showing an example of the structural arrangement of a sheet sorting apparatus as a sorting apparatus according to the present invention.

As shown in FIG. 1, the sheet sorting apparatus includes processing units such as a feeding unit 11, a pickup unit 12, an rejection detection unit 13, a pre-barcode reading unit 14, a character recognition unit 15, a delay convey unit 16, a printing unit 17, a verify barcode reading unit 18, a branching unit 19, and a stacker collection unit 20. These processing units are controlled by a control system to be described later.

Sheets to be sorted by the sheet sorting apparatus are placed on the feeding unit 11. Each sheet is assumed to be the one having the first surface on which number information indicating a specific area and character string information indicating the location are written or printed as sorting information. The sheets are contained in the feeding unit 11 in a standing position such that their trailing edges are trued up with the first surfaces facing in the same direction. The feeding unit 11 sequentially feeds these sheets to a predetermined pickup position. The pickup unit 12 provided at the above sheet pickup position picks up sheets, fed to the feeding unit 11, one by one at predetermined intervals along the convey path. The sheets contained in the feeding unit 11 are aligned with each other and set such that an area of each sheet on which number information (e.g., a postal code) indicating a specific area as sorting information when the sheet is fed to the pickup position is written is located on the upstream side.

The sheets picked up by the pickup unit 12 at predetermined pickup intervals are conveyed at predetermined convey intervals (pitch) by the convey path having a convey belt which runs at a constant speed. The rejection detection unit 13 which detects sheets to be rejected is provided on the above main convey path. The rejection detection unit 13 determines whether subsequent processing (mechanical processing) can be done, and rejects a sheet determined to be incapable of being mechanically processed. An rejection/collection unit (not shown) which rejects sheets determined to be incapable of being mechanically processed upon detection by the rejection detection unit 13 is provided on a branch convey path branching from the main convey path on the downstream side of the rejection detection unit 13.

For example, the rejection detection unit 13 described above includes a foreign substance detection sensor 64 (to be described later) which detects whether any foreign substance is contained in a sheet, and a metal detection unit 65 (to be described later) which detects whether any metal piece is contained in a sheet. With these detection mechanisms, the rejection detection unit 13 detects whether any foreign substance or metal piece having a possibility of causing a problem in mechanical processing is contained in a sheet. The rejection detection unit 13 collects sheets each determined to have a possibility of causing a problem in mechanical processing into the rejection/collection unit (not shown), and conveys other sheets to the succeeding processing unit. The metal detection unit 65 will be described in detail later.

A reader is provided on the main convey path on the downstream side of the rejection detection unit 13. The reader includes a pre-barcode reading unit 14 which reads a barcode attached to a sheet in advance and a character recognition unit (OCR scanner unit) 15 which reads an image on the first surface of a sheet on which character information comprising a character string is recorded.

In the reader, the pre-barcode reading unit 14 reads a barcode from a sheet attached in advance with the barcode. The sorting information of the sheet attached with the barcode is recognized on the basis of the information indicated by the barcode read by the pre-barcode reading unit 14.

In the reader, the character recognition unit 15 recognizes sorting information (e.g., a postal code or address information) as character information written on the first surface of a sheet which is not attached in advance with any barcode. The character recognition unit 15 optically reads/scans the first surface of the sheet on which sorting information (information indicating the sorting destination of the sheet) as character string information is recorded, by using a scanner. The character recognition unit 15 recognizes the sorting information recorded on the first surface of the sheet by performing OCR processing for the image read by the scanner. A main control unit 31 (to be described later) can execute OCR processing for the image read by the scanner.

The delay convey unit 16 is provided behind the character recognition unit 15. The delay convey unit 16 is a convey path for conveying a sheet, whose first surface image is read by the scanner of the character recognition unit 15, for a predetermined period of time. The delay convey unit 16 is a convey path for obtaining a time for allowing the operator to input, for example, sorting information of a sheet whose sorting information could not be recognized by the character recognition unit 15.

Assume that the above sheet sorting apparatus uses a system (online video coding system: online VCS) by which the operator inputs sorting information of a sheet, whose sorting information could not be recognized by the character recognition unit 15, by the time the sheet is conveyed to the printing unit 17. The online VCS (not shown) is a system which displays, on a monitor, an image of a sheet, whose sorting information could not be recognized by the character recognition unit 15, for a period during which the sheet is conveyed by the delay convey unit 16, and makes the operator input sorting information by using an operation unit such as a keyboard. That is, in the above sheet sorting apparatus, the time during which a sheet is conveyed by the delay convey unit 16 can be assigned as a processing time for acquiring sorting information by the above online VCS.

The printing unit 17 prints barcode information indicating sorting information on a sheet conveyed by the delay convey unit 16. The printing unit 17 prints sorting information corresponding to a barcode read by the pre-barcode reading unit 14, sorting information recognized by the character recognition unit 15, or a barcode based on sorting information input by the operator using the online VCS. The sheet on which barcode information is printed by the printing unit 17 is conveyed to the verify barcode reading unit 18. The verify barcode reading unit 18 reads the barcode information printed on the sheet, which is printed by the printing unit 17, to check the information. The sheet whose barcode information is read by the verify barcode reading unit 18 is conveyed to the branching unit 19. The sorting destination (a stacker in the stacker collection unit 20) of the sheet is determined on the basis of the read result obtained by the verify barcode reading unit 18.

The branching unit 19 branches a sheet to a desired convey path (bin path) so as to collect the sheet onto the sorting destination determined on the basis of the read result obtained by the verify barcode reading unit 18, thereby feeding the sheet to the stacker collection unit 20. The branching unit 19 includes a plurality of bin path gates for selectively feeding sheets to a plurality of bin paths of the stacker collection unit 20. That is, the branching unit 19 selectively feeds sheets to the respective bin paths of the stacker collection unit 20 by driving the bin path gates on the basis of the sorting information of each sheet.

The stacker collection unit 20 includes a plurality of stackers partitioned into a plurality of steps and a plurality of rows. For example, the stacker collection unit 20 comprises M (stage)×N (row) stackers. A convey path (bin path) is provided above each stacker of the stacker collection unit 20 to convey a sheet distributed by each bin path gate of the branching unit 19. Each stacker is provided with a sorting gate for receiving a sheet from the above bin path. With this arrangement, the stacker collection unit 20 selectively switches the above sorting gates on the basis of the sorting information of each sheet so as to make the respective stackers receive and collect sheets distributed by the above bin path gates of the branching unit 19.

An example of the arrangement of a control system in the sheet sorting apparatus having the above arrangement will be described next.

Figure 2:
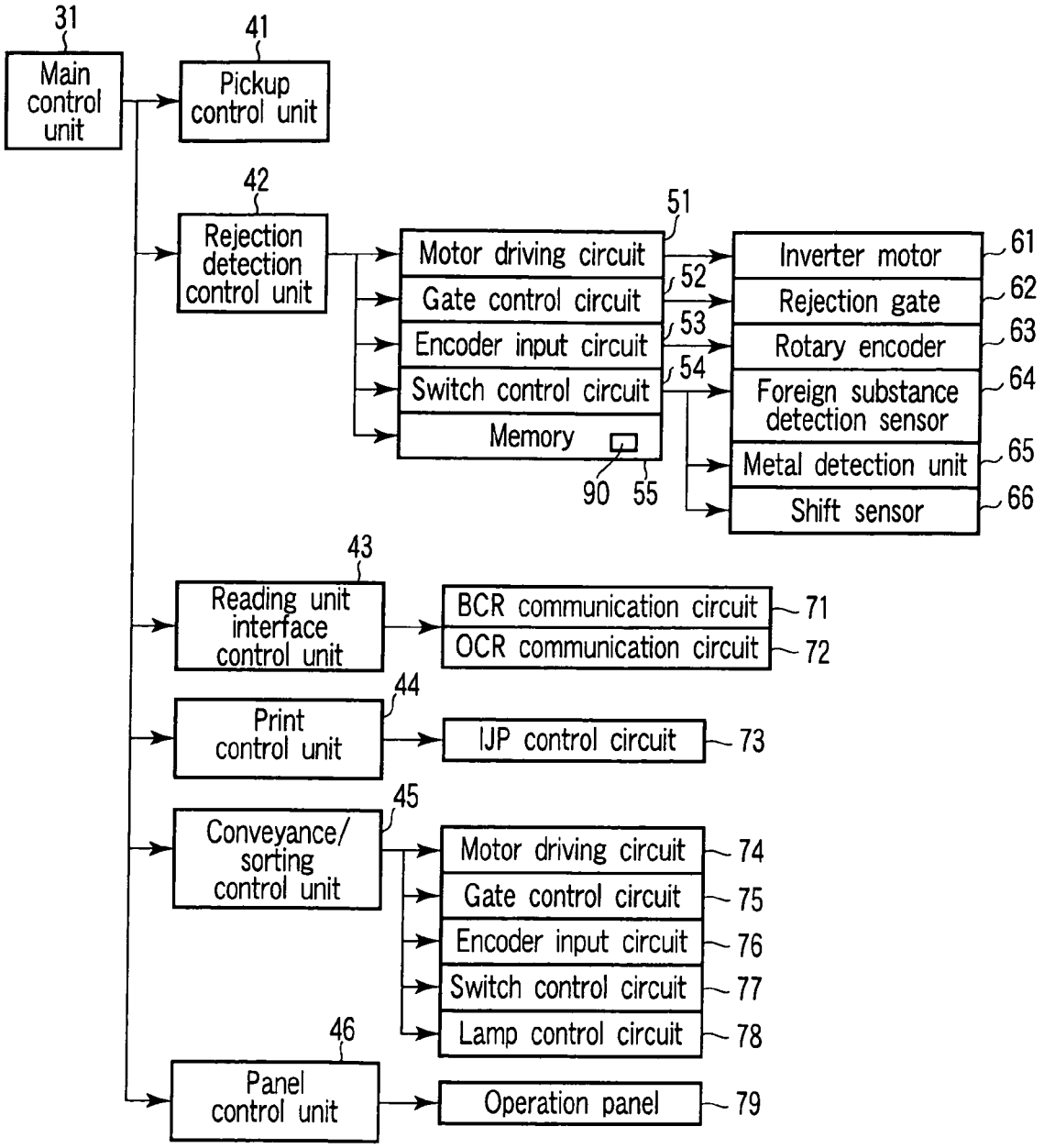
FIG. 2 is a block diagram showing an example of the arrangement of the control system of the sheet sorting apparatus.

FIG. 2 is a block diagram schematically showing the arrangement of the control system in the sheet sorting apparatus.

As shown in FIG. 2, the sheet sorting apparatus includes the main control unit 31 which controls the overall apparatus by controlling each unit in the apparatus. Assume that the main control unit 31 includes a database (not shown) in which sorting information is made to correspond to each stacker. With this arrangement, the main control unit 31 determines a stacker in which a given sheet is to be sorted/stacked on the basis of the sorting information of the sheet.

As shown in FIG. 2, a pickup control unit 41, an rejection detection control unit 42, a reading unit interface control unit 43, a print control unit 44, a conveyance & sorting control unit (conveyance/sorting control unit) 45, a panel control unit 46, and the like are connected to the main control unit 31.

The pickup control unit 41 controls the feeding unit 11, the pickup unit 12, their peripheral mechanisms, and the like. The pickup control unit 41 controls, for example, the operation of feeding and picking up sheets set in the feeding unit 11.

The rejection detection control unit 42 controls the rejection detection unit 13. A motor driving circuit 51, a gate control circuit 52, an encoder input circuit 53, a switch control circuit 54, a memory 55, and the like are connected to the rejection detection control unit 42.

The motor driving circuit 51 is a circuit which drives an inverter motor 61 on the basis of an operation instruction from the rejection detection control unit 42. The inverter motor 61 is a motor which drives a convey belt in the rejection detection unit 13. The inverter motor 61 drives the convey mechanism comprising the convey belt and the like to convey a sheet in the rejection detection unit 13.

The gate control circuit 52 drives an rejection gate 62 on the basis of an operation instruction from the rejection detection control unit 42. A sheet in the rejection detection unit 13 is selectively conveyed to the pre-barcode reading unit 14 or the rejection/collection unit (not shown) by the rejection gate driven by the gate control circuit 52. That is, the gate control circuit 52 conveys a sheet determined to be rejected to the rejection/collection unit by the above rejection gate. The gate control circuit 52 conveys a sheet determined not to be rejected to the pre-barcode reading unit 14.

The encoder input circuit 53 is connected to a rotary encoder 63 in the rejection detection unit 13. The encoder input circuit 53 detects the convey speed of a sheet in the rejection detection unit 13 on the basis of a signal from the rotary encoder 63. For example, the encoder input circuit 53 detects the convey speed of a sheet on the basis of a signal representing the driving speed of the convey belt or the driving speed of the inverter motor 61.

The switch control circuit 54 is connected to the foreign substance detection sensor 64, the metal detection unit 65, a shift sensor 66, and the like. The shift sensor 66 is a sensor for detecting the presence/absence (passage) of a sheet at a predetermined position in the rejection detection unit 13. For example, the switch control circuit 54 detects the driving timing of the rejection gate 62 in accordance with the detection result obtained by the shift sensor 66 placed in front of the rejection gate 62. The switch control circuit 54 also detects the timing for the execution of metal detection processing in accordance with the detection result obtained by the shift sensor (trigger sensor) 66 placed in front of the metal detection unit 65.

The foreign substance detection sensor 64 is a sensor for detecting whether any foreign substance to be rejected is contained in a sheet. The switch control circuit 54 acquires a detection result from the foreign substance detection sensor 64 and supplies it to the rejection detection control unit 42. This makes the rejection detection control unit 42 detect a sheet to be rejected because of the mixing of a foreign substance on the basis of the detection result obtained by the foreign substance detection sensor.

The metal detection unit 65 includes a plurality of metal detection sensors for detecting whether any metal pieces are contained in sheets. Each sensor in the metal detection unit 65 detects the presence/absence of a metal piece in a sheet at a predetermined position. The switch control circuit 54 acquires the detection result obtained by each sensor of the metal detection unit 65, and supplies it to the rejection detection control unit 42. With this operation, the rejection detection control unit 42 detects a sheet to be rejected because of the mixing of a metal piece on the basis of the detection result obtained by each sensor of the metal detection unit 65. The arrangement of each sensor described above and determination processing for a sheet to be rejected on the basis of the detection result obtained by each sensor will be described in detail later.

The memory 55 is a storage device for holding various types of information. Assume that the memory 55 is provided with a counter table 90 for holding the detection result obtained by each metal detection sensor for each sheet. The counter table 90 will be described in detail later.

The reading unit interface control unit 43 performs control to supply the information read by the pre-barcode reading unit 14, verify barcode reading unit 18, or character recognition unit 15 to the main control unit 31 and the like. The reading unit interface control unit 43 includes a barcode reading unit (BCR) communication circuit 71 and a character recognition unit (OCR) communication circuit 72.

The BCR communication circuit 71 is connected to the pre-barcode reading unit 14 and the verify barcode reading unit 18. The BCR communication circuit 71 supplies the barcode information read by the pre-barcode reading unit 14 and verify barcode reading unit 18 to the reading unit interface control unit 43. The OCR communication circuit 72 is connected to the character recognition unit 15. The OCR communication circuit 72 supplies an image of a sheet read by the character recognition unit 15 to the reading unit interface control unit 43.

The print control unit 44 controls the operation of printing (IJP) the barcode information based on the sorting information of a sheet on the sheet by using the printing unit 17.

The conveyance & sorting control unit 45 controls operation such as conveying a sheet in the sorting apparatus and collecting a sheet onto each stacker. As shown in FIG. 2, a motor driving circuit 74, a gate control circuit 75, an encoder input circuit 76, a switch control circuit 77, a lamp control circuit 78, and the like are connected to the conveyance & sorting control unit 45.

The motor driving circuit 74 is a circuit which drives an inverter motor (not shown) for driving the convey belt in the sorting apparatus (not shown) on the basis of an operation instruction from the conveyance & sorting control unit 45.

The gate control circuit 75 drives the bin path gates of the branching unit 19 or the sorting gates of the respective stackers in the stacker collection unit 20. Each sheet is collected in a stacker corresponding to sorting information by the bin path gate or sorting gate controlled by the gate control circuit 75.

The encoder input circuit 76 is connected to a rotary encoder (not shown) for detecting the driving speed of the convey belt (not shown) at each portion in the sorting apparatus. The encoder input circuit 76 detects the convey speed of a sheet from a signal representing the driving speed of the convey belt, which is supplied from the above rotary encoder, or the driving speed of the inverter motor.

The switch control circuit 77 is connected to a shift sensor, a full state detection sensor, a switch (none of which are shown), and the like. For example, the switch control circuit 77 detects the driving timing of each sorting gate in accordance with the detection result obtained by each shift sensor placed, for example, in front of each sorting gate. The switch control circuit 77 monitors the collection state of sheets in each stacker in accordance with the detection result obtained by the above full state detection sensor. The switch control circuit 77 also detects inputs to switches (not shown) with which the operator inputs various operation instructions.

The lamp control circuit 78 is connected to a full state lamp provided for each stacker or a display unit (not shown) such as an LED. The lamp control circuit 78 is a circuit which turns on/off the full state lamps or LEDs.

The panel control unit 46 is connected to an operation panel (not shown) or the like. The panel control unit 46 controls operation, e.g., displaying information about the collection state of sheets or information such as an operation failure in the sorting apparatus on the operation panel (not shown), and notifying the main control unit 31 of information input to the operation panel.

The arrangement of the metal detection unit 65 in the rejection detection unit 13 will be described next.

Figure 3:
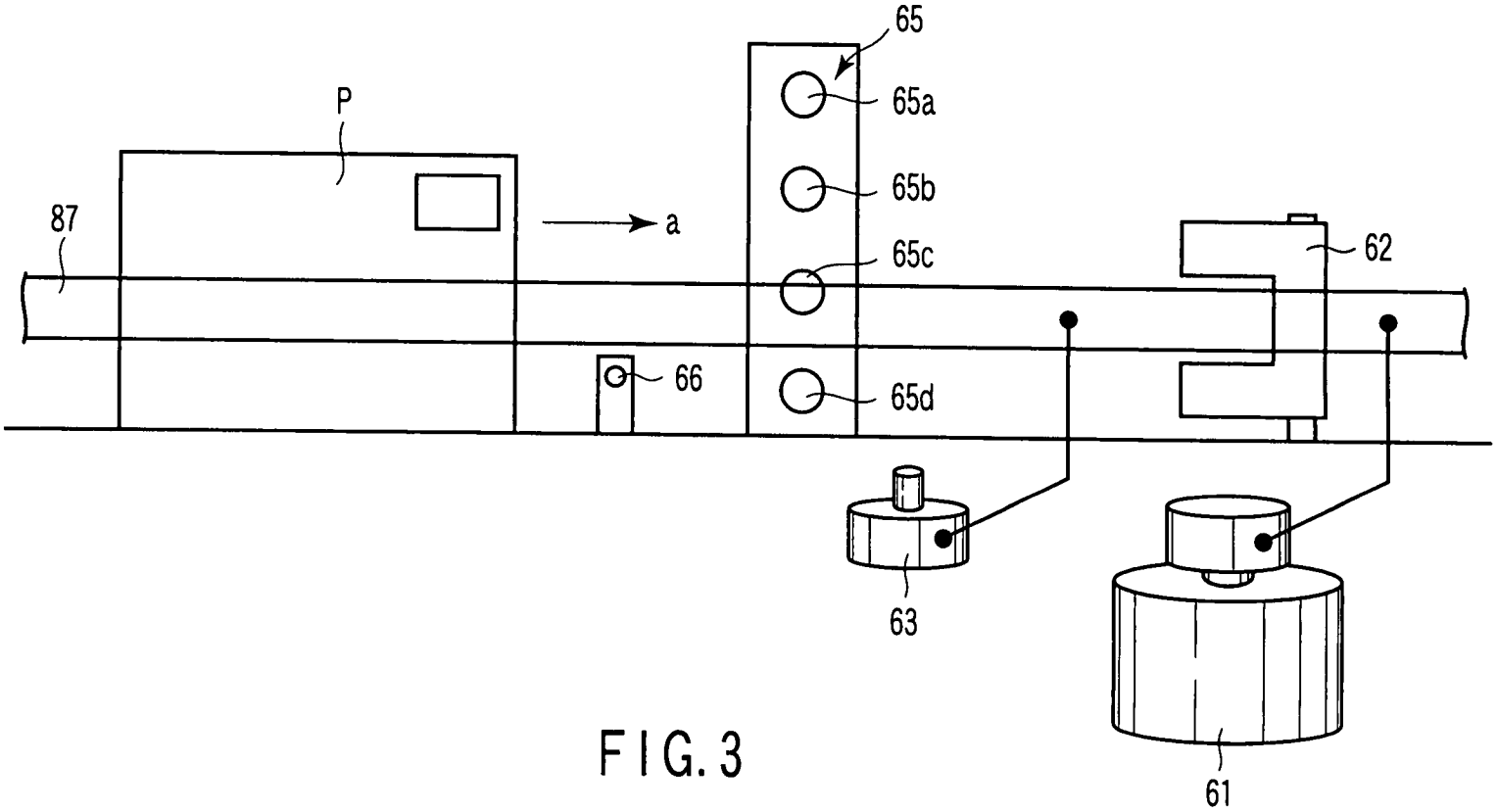
FIG. 3 is a view showing an example of the arrangement of a metal detection unit and its peripheral units.

FIG. 3 is a view showing an example of the arrangement of peripheral units of the metal detection unit 65 in the rejection detection unit 13.

In the case shown in FIG. 3, a sheet P is conveyed by a convey belt 81 driven by the inverter motor 61 in the rejection detection unit 13. In addition, in the case shown in FIG. 3, the sheet P is conveyed in a standing position in the direction indicated by an arrow a in FIG. 3 in the rejection detection unit 13. The sheet P conveyed in a standing position by the convey belt 81 is detected by the shift sensor (trigger sensor) 66, and then passes through the metal detection unit 65. The rotary encoder 63 detects the convey speed of a sheet conveyed by the convey belt 81. Therefore, the timing at which the sheet P conveyed by the convey belt 81 passes through the metal detection unit 65 is discriminated on the basis of the convey speed detected by the rotary encoder 63 and the positional relationship between the shift sensor 66 and the metal detection unit 65.

The metal detection unit 65 includes four metal detection sensors 65*a*, 65*b*, 65*c*, and 65*d*. The metal detection sensors 65*a*, 65*b*, 65*c*, and 65*d* of the metal detection unit 65 are arranged downward in the order named. For example, in the metal detection unit 65, the metal detection sensor 65*d* detects a metal piece contained in the lowest area of the conveyed sheet P, as shown in FIG. 3. Based on the detection pattern of a metal piece obtained by each of the metal detection sensors 65*a*, 65*b*, 65*c*, and 65*d*, it is determined whether the sheet P is to be rejected.

Assume that the switch control circuit 54 receives the metal detection result obtained by each of the metal detection sensors 65*a*, 65*b*, 65*c*, and 65*d* at predetermined time intervals (e.g., at 1-msec intervals). In other words, the metal detection sensors 65*a*, 65*b*, 65*c*, and 65*d* detect the presence/absence of a metal piece at the heights at which they are respectively placed (the positions in a direction perpendicular to the convey direction) at predetermined time intervals. With this arrangement, the metal detection unit 65 detects, at each of the predetermined heights (the positions in the direction perpendicular to the convey direction), the presence/absence of a metal piece at each position (each position in the convey direction) determined by the time intervals of metal detection and the convey speed. That is, the metal detection unit 65 can detect the two-dimensional position of a metal piece in an entire sheet.

The sheet P having passed through the metal detection unit 65 is conveyed to the rejection gate 62. Whether to reject the sheet P is determined on the basis of the above metal detection result at least by the time the sheet P reaches the rejection gate 62. That is, if it is determined that the sheet P should be rejected, the rejection gate 62 is driven to convey the sheet P to the rejection/collection unit. If it is determined that the sheet should not be rejected, the rejection gate 62 is driven to convey the sheet P to the succeeding processing unit (the pre-barcode reading unit 14 in the example of the arrangement shown in FIG. 1).

Determination processing for a sheet to be rejected which is based on the detection result obtained by the metal detection unit 65 will be described next.

This sorting apparatus determines, as a sheet to be rejected, a sheet containing a metal piece which is likely to cause a problem in mechanical processing, and determines, as a sheet not to be rejected, a sheet which does not contain any metal piece or a sheet which is not likely to cause any problem in mechanical processing even if it contains a metal piece. That is, this sorting apparatus performs the processing of determining whether to reject or not with respect to a sheet containing a metal piece (i.e., a sheet from which a metal piece is detected).

In this case, sealed letters containing metal pieces such as coins and keys are assumed as sheets containing metal pieces which are likely to cause problems in mechanical processing (sheets to be rejected). This is because, if a sealed letter contains a metal piece such as a coin or key, there is a high possibility that the sealed letter is torn and the metal piece flies out or moves to an unexpected position to cause a conveyance failure.

In contrast to this, tracking letters having predetermined structures (e.g., transponder letters and vibration letters) are assumed as sheets determined not to be rejected even if they contain metal pieces. In addition, sealed letters containing documents bound with small metal clips, small fastening pins (e.g., staples), and the like (which will be referred to as clip letters hereinafter) are assumed as sheets not to be rejected. In the above tracking letter, a metal portion is small and fixed at a predetermined position, as will be described later. In the clip letter, a metal portion is small and fixed at an arbitrary position. The above tracking letters and click letters are not likely to cause any problems such as conveyance failures in processing steps in the sorting apparatus even if they are not rejected.

In consideration of the above situation, this sorting apparatus does not reject the above tracking letters and clip letters, of sheets from which metal pieces are detected, and sets such letters as processing targets.

The relationship between various types of sheets and the metal detection unit 65 will be described next.

Figure 4:
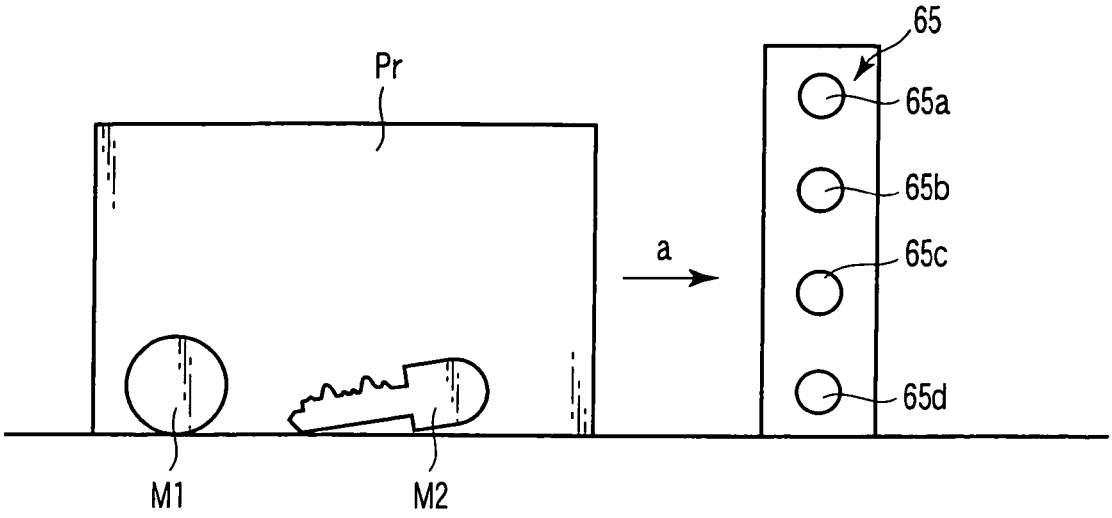
FIG. 4 is a view showing an example of an rejection letter.

FIG. 4 is a view for explaining the conveyed state of a sealed letter (sheet) Pr containing a metal piece such as a metal piece (coin) M1 or metal piece (key) M2. Assume that the sealed letter Pr containing a metal piece such as the coin M1 or key M2 shown in FIG. 4 is likely to cause a problem in mechanical processing, and hence will be handled as a sheet to be rejected (rejection letter).

While the sealed letter (rejection letter) Pr containing a metal piece such as the coin M1 or key M2 is set in a standing position (conveyed), as shown in FIG. 4, the metal piece is located at the lowest position due to its own weight (gravity). With regard to the sealed letter Pr shown in FIG. 4, in the metal detection unit 65, only the metal detection sensor 65*d*, which detects the presence/absence of a metal piece in the lowest area of a conveyed sheet, detects the metal piece, but the metal detection sensors 65*a*, 65*b*, and 65*c* do not detect the metal piece. In other words, if the metal member put in the sealed letter P and located at the bottom of the sheet in a conveyed state is small enough not to reach the detection position of the metal detection sensor 65*c*, only the metal detection sensor 65*d* of the metal detection unit 65 detects the metal piece in the sealed letter P.

Figure 5:
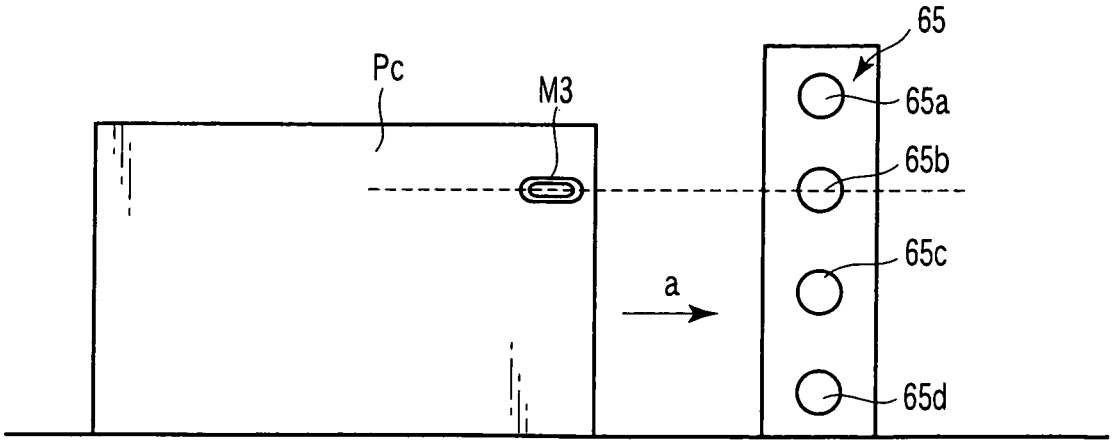
FIG. 5 is a view showing an example of a clip letter.

FIG. 5 is a view for explaining the conveyed state 24; of a clip letter (sheet) Pc containing documents fastened with a small metal clip M3. Assume that the clip letter Pc shown in FIG. 5 is handled as a sheet (a letter to be processed) which should not be rejected because it is unlikely to cause any problem in mechanical processing.

In the sealed letter (sheet) Pc containing documents fastened with the small metal clip M3 as shown in FIG. 5, a change in the position of the clip due to gravity is small regardless of the conveyed state. With regard to the clip letter Pc shown in FIG. 5, only the metal detection sensor 65*b* corresponding to the position of the clip M3 detects the metal piece.

In general, in a sealed letter (clip letter) containing documents fastened with a small fastening plate such as a small metal clip or small fastening pin, a metal piece is detected only at an arbitrary portion of the sheet. That is, in a clip letter, a fastening plate (metal piece) can be located at a position at which it is detected by the metal detection sensor 65*d*. In general, however, as shown in FIG. 4, it is estimated that a metal piece in a clip letter tends to be detected by the metal detection sensors 65*a*, 65*b*, and 65*c* other than the metal detection sensor 65*d*. In consideration of this situation, when a metal piece is detected by only the metal detection sensor 65*a*, 65*b*, or 65*c* other than the metal detection sensor 65*d*, it can be determined that the letter is likely to be a clip letter as a letter which need not be rejected, as shown in FIG. 4. That is, if a metal piece is detected in only an area of a sheet in a standing position (conveyed state) other than the lowest area, it can be determined that the sheet is likely to contain a metal piece fixed at a specific position. Such a sheet determined as a clip letter is not likely to cause any problem in mechanical processing, and hence control can be performed not to reject it.

Figure 6:
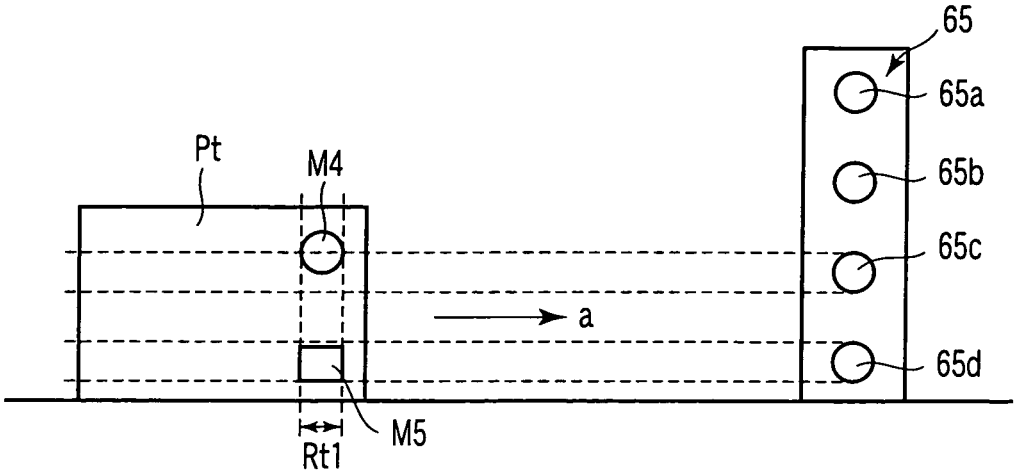
FIG. 6 is a view showing an example of a transponder letter (tracking letter)
Figure 7:
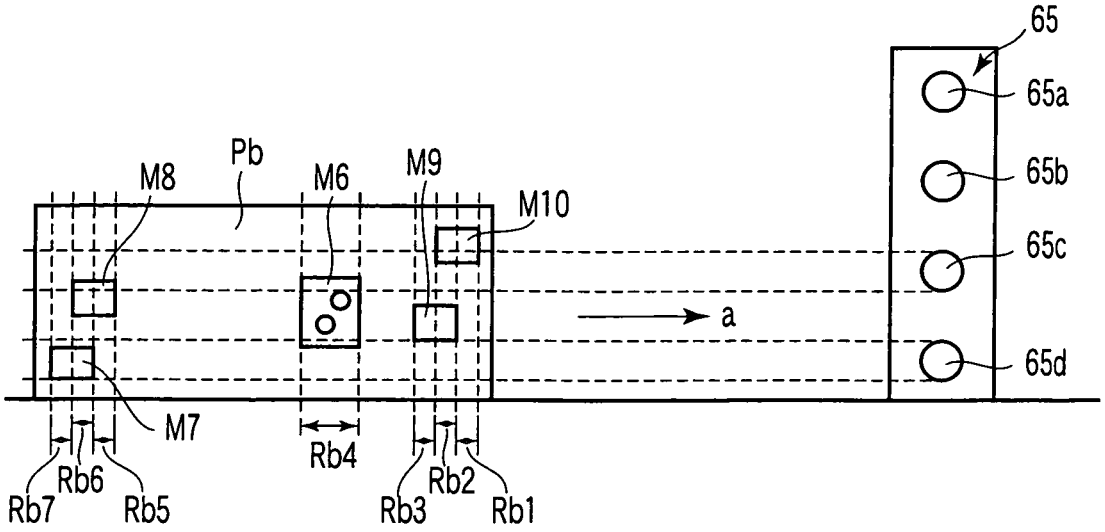
FIG. 7 is a view showing an example of a vibration letter (tracking letter)

FIG. 6 is a view for explaining the conveyed state of the transponder letter (sheet) Pt as one type of tracking letter. FIG. 7 is a view for explaining the conveyed state of the vibration letter (sheet) Pb as one type of tracking letter. Assume that the transponder letter Pt shown in FIG. 6 or the vibration letter Pb shown in FIG. 7 is not likely to cause any problem in mechanical processing, and hence is handled as a sheet not to be rejected (a letter to be processed).

The tracking letters are special letters for determining the states of sheets as postal matter collected from a given place until the sheets are sent to destinations (addresses). The transponder letter Pt and the vibration letter Pb are types of tracking letters. It is therefore preferable that the transponder letter Pt and the vibration letter Pb are processed as in the same manner as general sheets as possible. When the transponder letter Pt or the vibration letter Pb mixes in sheets to be sorted, this sorting apparatus preferably sorts the transponder letter Pt or the vibration letter Pb within the apparatus in the same manner as other sheets.

In the transponder letter Pt shown in FIG. 6 and the vibration letter Pb shown in FIG. 7, changes in the positions of metal portions due to gravity are small regardless of the conveyed states of the letters. Therefore, the transponder letter Pt and the vibration letter Pb can be detected on the basis of the detection patterns obtained by the respective metal detection sensors of the metal detection unit 65.

As shown in FIG. 6, for example, the transponder letter Pt has a metal piece (battery) M4 and a metal piece M5 at predetermined positions. In the case shown in FIG. 6, the metal detection sensors 65*c* and 65*d* detect the metal pieces M4 and M5 in the transponder letter Pt at almost the same timing. It can therefore be determined (estimated), on the basis of the timing at which the metal detection sensors 65*c* and 65*d* simultaneously detect metal pieces, whether the sheet is the transponder letter Pt.

As shown in FIG. 7, the vibration letter Pb has metal pieces M7, M8, M9, and M10 at predetermined positions in addition to a metal piece (small circuit board) M6. In the case shown in FIG. 7, there are areas where the metal piece (circuit board) M6 in the vibration letter Pb is simultaneously detected by the metal detection sensors 65*c* and 65*d*, and the metal pieces M9 and M10 and the metal pieces M7 and M8 are simultaneously detected by the metal detection sensors 65*c* and 65*d*, respectively. It can therefore be determined (estimated), on the basis of the timing at which the metal detection sensors 65*c* and 65*d* simultaneously detect metal pieces, whether the sheet is the vibration letter Pb.

That is, a sheet in which the arrangement of metal pieces is determined in advance can be detected on the basis of the detection patterns obtained by the metal detection sensors 65*a*, 65*b*, 65*c*, and 65*d* of the metal detection unit 65. The sheet sorting apparatus of this embodiment detects a tracking letter in which the arrangement of metal pieces is determined in advance as shown in FIG. 6 or 7, on the basis of the detection patterns obtained by the metal detection sensors 65*a*, 65*b*, 65*c*, and 65*d*.

The metal detection patterns obtained by the metal detection sensors 65*a*, 65*b*, 65*c*, and 65*d* will be described next.

Assume that the metal detection sensors 65*a*, 65*b*, 65*c*, and 65*d* detect the presence/absence of a metal piece in the sheet P during conveyance at predetermined time intervals (e.g., at 1-msec intervals). The metal detection pattern based on the detection results obtained by the metal detection sensors 65*a*, 65*b*, 65*c*, and 65*d* can be determined by various techniques. This embodiment will mainly exemplify a technique of determining a metal detection pattern by using the counter table 90 which counts the number of times each sensor has detected a metal piece.

Figure 8:
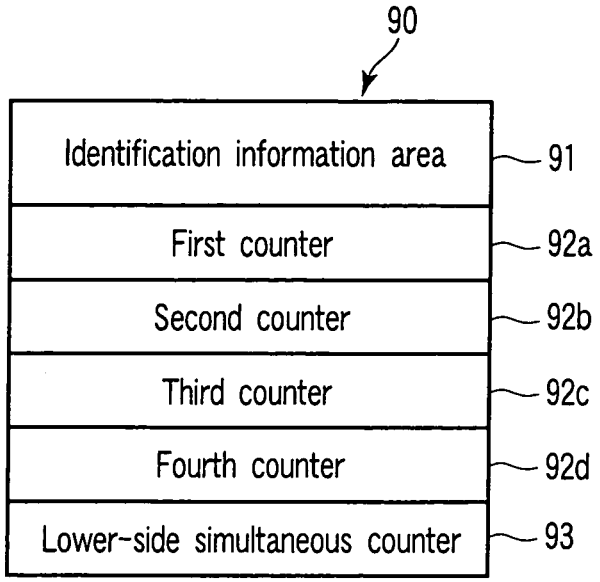
FIG. 8 is a view showing an example of the arrangement of a counter table.
Figure 9:
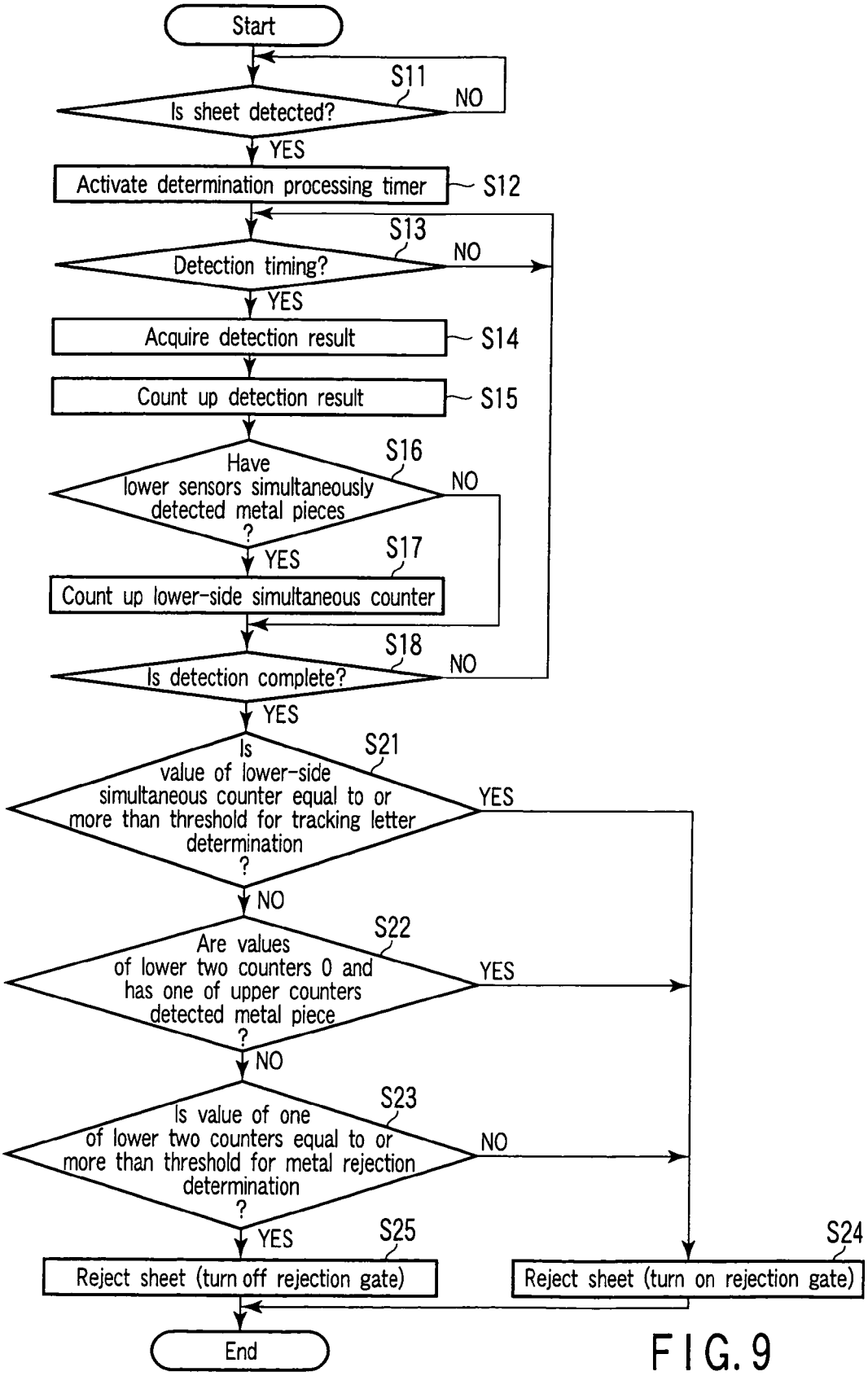
FIG. 9 is a flowchart for explaining an example of metal detection processing.

FIG. 8 is a view showing an example of the arrangement of the counter table 90 for determining a metal detection pattern for each sheet.

The counter table 90 is generated for each sheet. In the case shown in FIG. 8, the counter table 90 comprises an identification information area 91, a first counter 92*a*, a second counter 92*b*, a third counter 92*c*, a fourth counter 92*d*, and a lower-side simultaneous counter 93.

The identification information area 91 stores identification information for uniquely identifying a sheet. Identification information stored in the identification information area 91 is, for example, information such as a mail number assigned to each sheet. As the mail number, for example, one of 1 to 16383 (0001 to 3FFF) is assigned to each sheet. The identification information can include information indicating the state of each sheet in addition to the mail number or the like. For example, the identification information can have information indicating "double feed" at the most significant bit.

The first, second, third, and fourth counters 92*a* to 92*d* count the numbers of times the metal detection sensors 65*a* to 65*d* detect metal pieces. Note that the first, second, third, and fourth counters function as counters which store count values for determining in determination processing (to be described later) whether the sheet is a clip letter.

The first counter 92*a* stores the number of times the metal detection sensor 65*a* (to be also referred to as the first sensor hereinafter) has detected metal pieces in the sheet identified by the identification information in the identification information area 91. That is, the first counter 92*a* counts up when the first sensor 65*a* detects a metal piece at each timing.

The second counter 92*b* stores the number of times the metal detection sensor 65*b* (to be also referred to as the second sensor hereinafter) has detected metal pieces in the sheet identified by the identification information in the identification information area 91. That is, the second counter 92*b* counts up when the second sensor 65*b* detects a metal piece at each timing.

The third counter 92*c* stores the number of times the metal detection sensor 65*c* (to be also referred to as the third sensor hereinafter) has detected metal pieces in the sheet identified by the identification information in the identification information area 91. That is, the third counter 92*c* counts up when the third sensor 65*c* detects a metal piece at each timing.

The fourth counter 92*d* stores the number of times the metal detection sensor 65*d* (to be also referred to as the fourth sensor hereinafter) has detected metal pieces in the sheet identified by the identification information in the identification information area 91. That is, the fourth counter 92*d* counts up when the fourth sensor 65*d* detects a metal piece at each timing.

The lower-side simultaneous counter 93 stores the number of times only the fourth and third sensors 65*d* and 65*c* have simultaneously detected metal pieces. That is, in accordance with the detection results acquired by all the sensors at each timing, the lower-side simultaneous counter 93 counts up when only the fourth and third sensors 65*d* and 65*c* detect a metal piece. The lower-side simultaneous counter 93 functions as a tracking letter counter which stores a count value for determining in determination processing (to be described later) whether the sheet is a tracking letter.

An outline of tracking letter determination processing using the above counter table 90 will be described next.

The above tracking letter is determined on the basis of the count value obtained by the lower-side simultaneous counter 93. As shown in FIGS. 6 and 7, the above tracking letter has an area where only the metal detection sensors 65*d* and 65*c* simultaneously detect a metal piece. In consideration of this point, whether a given sheet is a tracking letter can be determined depending on whether the count value of the lower-side simultaneous counter 93 is equal to or more than a predetermined threshold. In order to detect a tracking letter on the basis of the detection result obtained by each sensor, the sheet sorting apparatus according to this embodiment determines whether a given sheet is a tracking letter, depending on whether the count value of the lower-side simultaneous counter 93 is equal to or more than a predetermined threshold.

In this embodiment, a tracking letter is assumed to be a letter in which the arrangement of metal pieces is specified in advance. For this reason, as described above, whether a given sheet is a tracking letter can be determined depending on whether the number of times a plurality of specific counters (the sensors 65*c* and 65*d*) have simultaneously detected a metal piece is equal to or more than a predetermined threshold. In other words, whether a given sheet is a tracking letter can be determined depending on whether the arrangement of metal pieces is similar to the arrangement of a tracking letter which is specified in advance. For this reason, in addition to the above threshold, it is possible to set various thresholds corresponding to the arrangements of metal pieces in tracking letters.

For example, the transponder letter Pt shown in FIG. 6 has an area Rt1 where only the metal detection sensors 65*d* and 65*c* simultaneously detect metal pieces. In the remaining area, no metal piece is detected. Therefore, the number of times the metal detection sensors 65*d* and 65*c* have simultaneously detected metal pieces in the transponder letter Pt in a normal conveyed state (conveyed at a predetermined convey speed without skew) can be calculated in advance from the convey speed, the size of the area Rt1 (metal pieces M4 and M5) in the convey direction, the detection periods of the sensors 65*d* and 65*c*, and the like. That is, in consideration of an error ($\alpha$) to be tolerated in the number of times (Nt) the metal detection sensors 65*d* and 65*c* have simultaneously detected metal pieces, checking whether each of the count values of the third and fourth counters 92*c* and 92*d* is Nt$\pm\alpha$ makes it possible to determine whether the sheet is the transponder letter Pt shown in FIG. 6.

The vibration letter Pb shown in FIG. 7 has the following areas with predetermined sizes in the convey direction: areas Rb2, Rb4, and Rb6 where only the metal detection sensors 65*d* and 65*c* simultaneously detect metal pieces, areas Rb1 and Rb5 where only the metal detection sensor 65*c* detects metal pieces, areas Rb3 and Rb7 where only the metal detection sensor 65*d* detects metal pieces, and areas where no metal is detected. Therefore, the numbers of times the areas Rb1 to Rb7 of the vibration letter Pb in a normal conveyed state (conveyed at a predetermined convey speed without skew) are detected by the respective metal detection sensors can be calculated in advance from the convey speed, the sizes of the areas Rb1 to Rb7 in the convey direction, the detection periods of the sensors 65*d* and 65*c*, and the like. That is, in consideration of errors ($\alpha$1, $\alpha$2, and $\alpha$3) to be tolerated in the number of times (Nb1) the sensors 65*d* and 65*c* have simultaneously detected metal pieces, the number of times (Nb2) only the sensor 65*c* has detected a metal piece, and the number of times (Nb3) only the sensor 65*d* has detected a metal piece, whether the sheet is the vibration letter Pb shown in FIG. 6 can be determined depending on whether the count value of the lower-side simultaneous counter 93 is Nb1$\pm\alpha$1, the count value of the third counter 92*c* is Nb2$\pm\alpha$2, and the count value of the fourth counter 92*d* is Nb3$\pm\alpha$3.

Note that each sensor of the metal detection unit 65 acquires information indicating the presence/absence of a metal piece in a sheet during conveyance at a predetermined period. This makes it possible to discriminate the arrangement of metal pieces in each entire sheet on the basis of the detection result obtained by each sensor of the metal detection unit 65. If, for example, a two-dimensional memory area is secured to store the detection result obtained by each sensor with a lapse of time, information indicating the arrangement of metal pieces in each entire sheet is stored in the memory area. It is also possible to determine, on the basis of such information indicating the arrangement of metal pieces in an entire sheet, whether the sheet is a tracking letter having a specific arrangement of metal pieces.

An outline of tracking letter determination processing using the counter table 90 will be described next.

The above clip letter is determined on the basis of the count values of the first, second, third, and fourth counters 92*a* to 92*d*. As described above, this sorting apparatus is assumed to reject sheets containing metal pieces whose positions are not fixed, e.g., coins and keys, like those shown in FIG. 4. For this reason, when only the metal detection sensor 65*c* or 65*d* detects a metal piece while the metal detection sensors 65*b* and 65*a* detect no metal piece, it is detected that the corresponding sheet is a clip letter. For example, in the clip letter shown in FIG. 5, only the metal detection sensor 65*b* detects a metal piece while the metal detection sensors 65*d* and 65*c* detect no metal piece. The sheet sorting apparatus according to this embodiment detects a clip letter on the basis of the detection result obtained by each sensor. Assume therefore that whether a given sheet is a clip letter is determined depending on whether the count value of the first or second counter 92*d* or 92*c* is less than a predetermined value ("0" or "within an error range") and the count value of the third or fourth counter 92*b* or 92*a* is equal to or more than a predetermined threshold. That is, in this embodiment, in order to detect a clip letter, it is determined on the basis of the value of each counter whether a metal piece is fixed in an upper area of a sheet in a standing position.

In general, a clip or a fastening pin is a small metal piece and considered to be used to fasten end portions of documents. For this reason, discriminating whether a small metal piece is fixed on an end portion of a sheet can determine whether the sheet is a clip letter. If, for example, a two-dimensional memory area is secured to store the detection result obtained by each sensor with a lapse of time (a change in detection position in the convey direction), information indicating the arrangement of metal pieces in each entire sheet is stored in the memory area. It is also possible to determine, on the basis of such information indicating the arrangement of metal pieces in an entire sheet, whether the sheet is a clip letter containing a small metal fixed to an area on an end portion.

A sequence for metal detection processing corresponding to the detection result obtained by the metal detection unit 65 will be described next.

First of all, if a sheet is detected by the shift sensor (trigger sensor) 66 placed in front of the metal detection unit 65 in the rejection detection unit 13 (YES in step S11), the rejection detection control unit 42 sets a timer and starts metal detection processing for the sheet (step S12). The timer measures the time required for metal detection processing for the sheet. That is, the timer measures the time between the instant the leading edge of the sheet passes through the position at which each metal detection sensor of the metal detection unit 65 is placed and the instant the trailing edge of the sheet passes through the position (the time taken for the sheet to pass through the metal detection unit 65). Assume that when metal detection processing for the sheet is started, the counter table 90 in which the identification information of the sheet is stored in a identification information area is generated in the memory 55.

While the sheet passes through the metal detection unit 65, each of the metal detection sensors 65*a*, 65*b*, 65*c*, and 65*d* detects the presence/absence of a metal piece at a predetermined period (e.g., at 1-msec intervals). That is, at a predetermined detection timing (YES in step S13), the switch control circuit 54 acquires a signal representing the metal detection result from each of the metal detection sensors 65*a*, 65*b*, 65*c*, and 65*d* (step S14). The switch control circuit 54 supplies information indicating the metal detection result acquired from each of the metal detection sensors 65*a*, 65*b*, 65*c*, and 65*d* to the rejection detection control unit 42. The rejection detection control unit 42 updates the values of the first, second, third, and fourth counter 92*a*, 92*b*, 92*c*, and 92*d* on the basis of the pieces of information indicating the detection results acquired from the metal detection sensors 65*a*, 65*b*, 65*c*, and 65*d* through the switch control circuit 54 (step S15). That is, upon acquiring the pieces of information indicating the metal detection results obtained by the sensors 65*a*, 65*b*, 65*c*, and 65*d*, the rejection detection control unit 42 counts up the value of the counter corresponding to each sensor which has detected a metal piece.

Acquiring information indicating the metal detection result obtained by each of the metal detection sensors 65*a*, 65*b*, 65*c*, and 65*d*, the rejection detection control unit 42 determines whether only the sensors 65*c* and 65*d* have detected metal pieces (step S16). Upon determining that only the sensors 65*c* and 65*d* have detected metal pieces (YES in step S16), the rejection detection control unit 42 counts up the lower-side simultaneous counter 93 (step S17).

The processing in steps S13 to S17 (counting processing) is repeated until the trailing edge of the sheet passes through the metal detection unit 65. As a result, the counter table 90 corresponding to the sheet stores the number of times each sensor has detected a metal piece and the number of times only the lower two sensors 65*c* and 65*d* have detected metal pieces. Based on the information (count values) stored in the counter table 90, the rejection detection control unit 42 performs tracking letter determination, clip letter determination, and metal rejection determination.

That is, when the counting processing is terminated (YES in step S18), the rejection detection control unit 42 performs tracking letter determination processing of determining whether the sheet is a tracking letter (step S21). This tracking letter determination processing can be implemented by various techniques as described above. Assume that in this embodiment, whether a sheet is a tracking letter is determined depending on whether the count value of the lower-side simultaneous counter 93 is equal to or more than a predetermined threshold for tracking letter determination.

The rejection detection control unit 42 therefore determines whether the value of the lower-side simultaneous counter 93 in the counter table 90 corresponding the sheet is equal to or more than a predetermined threshold for tracking letter determination. If it is determined by this determination processing that the value of the lower-side simultaneous counter 93 is equal to or more than a threshold for tracking letter determination (YES in step S21), the rejection detection control unit 42 determines that the sheet is a tracking letter. If it is determined that the sheet is a tracking letter, the rejection detection control unit 42 performs control to turn on the rejection gate 62 so as to convey the sheet to the succeeding processing unit without rejecting it (step S24).

If it is determined by the above determination processing that the value of the lower-side simultaneous counter 93 is less than the threshold for tracking letter determination, i.e., that the sheet is not a tracking letter (NO in step S21), the rejection detection control unit 42 performs clip letter determination processing to determine whether the sheet is a clip letter (step S22). As described above, this clip letter determination processing can be implemented by various techniques. Assume that in this embodiment, whether the sheet is a clip letter is determined depending on whether the count values of the counters 92*c* and 92*d* corresponding to the lower two sensors 65*c* and 65*d* is less than a predetermined value ("0" or "within an error range") and one of the count values of the counters 92*a* and 92*b* corresponding to the upper two sensors 65*a* and 65*b* is equal to or more than a predetermined threshold for clip letter determination.

The rejection detection control unit 42 therefore determines whether the values of the third and fourth counters 92*c* and 92*d* in the counter table 90 corresponding to the sheet are less than the predetermined value and the value of the first or second counter 92*a* or 92*b* is equal to or more than the predetermined threshold for clip letter determination. If it is determined by this determination processing that the values of the third and fourth counters 92*c* and 92*d* are "0" or fall "within the error range" and the value of the first or second counter 92*a* or 92*b* is equal to or more than the predetermined threshold (YES in step S22), the rejection detection control unit 42 determines that the sheet is a clip letter. Upon determining that the sheet is a clip letter, the rejection detection control unit 42 performs control to turn on the rejection gate 62 so as to convey the sheet to the succeeding processing unit without rejecting it (step S24).

Upon determining that the sheet is not a clip letter (NO in step S22), the rejection detection control unit 42 performs rejection letter determination processing to determine whether the sheet is a sheet to be rejected (step S23). Assume that in this rejection letter determination processing in this embodiment, whether the sheet is a sheet to be rejected is determined depending on whether one of the count values of the third and fourth counters 92*c* and 92*d* corresponding to the lower two sensors 65*c* and 65*d* is equal to or more than a predetermined threshold for rejection determination. That is, the embodiment determines whether a metal piece is detected in a lower area of a sheet conveyed in a standing position.

The rejection detection control unit 42 therefore determines whether the value of the third or fourth counter 92*c* or 92*d* in the counter table 90 corresponding to the sheet is equal to or more than the predetermined threshold for rejection determination (step S23). Upon determining by this determination processing that the value of the third or fourth counter 92*c* or 92*d* is equal to or more than the predetermined threshold (YES in step S23), the rejection detection control unit 42 determines that the sheet is an rejection letter. Upon determining that the sheet is an rejection letter, the rejection detection control unit 42 performs control to turn off the rejection gate 62 so as to reject the sheet (convey it to the rejection/collection unit) (step S25). Determining by the above processing that the value of the third or fourth counter 92*c* or 92*d* is less than the predetermined threshold for rejection determination (NO in step S23), the rejection detection control unit 42 determines that the sheet is a normal letter. Upon determining that the sheet is a normal letter, the rejection detection control unit 42 performs control to turn on the rejection gate 62 so as to convey the sheet to the succeeding processing unit (step S24).

According to the above processing, this sheet sorting apparatus detects a tracking letter such as a transponder letter or vibration letter and a clip letter on the basis of the detection results obtained by a plurality of metal detection sensors for detecting, at various heights, the presence/absence of metal pieces in a sheet conveyed in a standing position. With this operation, the sheet sorting apparatus can reject sheets which are likely to cause problems in mechanical processing, e.g., sealed letters containing coins, keys, and the like while conveying tracking letters in which metal pieces are arranged at specific positions and clip letters in which small metal pieces such as fastening plates are fixed at arbitrary positions to the succeeding processing unit without rejecting them. This makes it possible to provide a sorting apparatus which can sort tracking letters and clip letters. In addition, since tracking letters can be sorted by processing steps similar to those for general sheets, it is easy to accurately grasp the processing state of the overall system using tracking letters. In addition, since the apparatus can sort clip letters, the work load on the operator can be reduced, thereby improving the efficiency of the overall sorting processing.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sorting apparatus, comprising:

a plurality of vertically arranged metal detection sensors, each of the sensors being configured to detect presence of a metal object contained within a letter that is disposed in a standing position on a conveying path, each of the sensors being arranged at a different predetermined height level within the vertical arrangement so as to detect the presence of the metal object at any of the predetermined height levels, each of the sensors being further configured to detect the presence of the metal object at predetermined time intervals, so as to detect a two-dimensional position of the metal object based on the detected presence at said any of the predetermined height levels and on the detected presence at any of said predetermined time intervals, the plurality of vertically arranged metal detection sensors being further configured to generate a height position detection pattern indicating the presence of the metal object at a corresponding height position in the letter, based on the detected two-dimensional position;

a determination unit configured to determine whether the letter having the detected metal object present should be rejected due to the metal object being movable within the letter, based on the generated height position detection pattern, the determination unit being further configured to determine that the letter should not be rejected due to the metal object being fixed within the letter, when the generated height position detection pattern indicates that at least one metal detection sensor of the plurality of metal detection sensors other than a metal detection sensor arranged at a lowest height level of the predetermined height levels detects the presence of the metal object; and a sorting unit configured to sort the letter that should not be rejected, based on sorting information of the letter and the determination of the determination unit.

2. The apparatus according to claim 1, which further comprises a convey unit configured to convey the letter in the standing position, and in which:

the plurality of vertically arranged metal detection sensors are further configured to detect, at the predetermined height levels, the presence of the metal object contained in the letter conveyed in the standing position a plurality of number of times at predetermined intervals, the determination unit is further configured to determine whether or not a number of times each of said metal detection sensors detects the metal object is a detection result for a tracking letter having a fixed metal portion, and the sorting unit is further configured to sort the letter based on the number of times each of the vertically arranged metal detection sensors detects the metal object is a detection result for the tracking letter.

3. The apparatus according to claim 2, the detection result for the tracking letter is based on a number of times specific metal detection sensors of the plurality of metal detection sensors have simultaneously detected the metal object, the number of times being not less than a first predetermined threshold.

4. The apparatus according to claim 3, wherein said detection result for the tracking letter is based on a first number of times a metal detection sensor at the lowest height level has detected the metal object, the first number of times being less than a second predetermined threshold, and wherein said detection result for the tracking letter is based on a second number of times metal detection sensors other than the sensor at the lowest height level has detected the metal object, the second number of times being not less than a third predetermined threshold.

5. The apparatus according to claim 2, wherein the detection result for the tracking letter is based on a first number of times a metal detection sensor at the lowest height level has detected the metal object, the first number of times being less than a second predetermined threshold, and wherein said detection result for the tracking letter is based on a second number of times sensors other than the sensor at the lowest height level has detected the metal object, the second number of times being not less than a third predetermined threshold.

6. A sorting apparatus, comprising:

a plurality of vertically arranged metal detection sensors, each of the sensors being configured to detect presence of a metal object contained within a letter that is disposed in a standing position on a conveying path, each of the sensors being arranged at a different predetermined height level within the vertical arrangement so as to detect the presence of the metal object at any of the predetermined height levels, each of the sensors being further configured to detect the presence of the metal object at predetermined time intervals, so as to detect a two-dimensional position of the metal object based on the detected presence at said any of the predetermined height levels and on the detected presence at any of said predetermined time intervals, the plurality of vertically arranged metal detection sensors being further configured to generate a height position detection pattern indicating the presence of the metal object at a corresponding height position in the letter, based on the detected two-dimensional position;

a determination unit configured to determine whether the letter having the detected metal object present should be rejected due to the metal object being movable within the letter, based on the generated height position detection pattern, the determination unit being further configured to determine that the letter should not be rejected due to the metal object being fixed within the letter, when the generated height position detection pattern indicates that more than one metal detection sensor of the plurality of metal detection sensors simultaneously detects the presence of the metal object; and a sorting unit configured to sort the letter determined to be a tracking letter, based on sorting information of the letter and the determination of the determination unit.

7. The apparatus according to claim 6, wherein a detection result for the tracking letter is based on a number of times specific sensors of said plurality of metal detection sensors have simultaneously detected the metal object, said number of times being not less than a first predetermined threshold.

8. The apparatus according to claim 7, wherein said detection result for the tracking letter is based on a first number of times a sensor at a lowest height level has detected the metal object, the first number of times being less than a second predetermined threshold, and wherein said detection result for the tracking letter is based on a second number of times sensors other than the sensor at the lowest height level has detected the metal object, the second number of times being not less than a third predetermined threshold.

9. The apparatus according to claim 6, wherein a detection result for the tracking letter is based on a first number of times a sensor at a lowest height level has detected the metal object, the first number of times being less than a second predetermined threshold, and wherein said detection result for the tracking letter is based on a second number of times sensors other than the sensor at the lowest height level has detected the metal object, the second number of times being not less than a third predetermined threshold.

* * * * *